US005441865A

United States Patent [19]

Lewis et al.

[11] Patent Number: 5,441,865

[45] Date of Patent: Aug. 15, 1995

[54] GELATIN-GRAFTED-POLYMER PARTICLES AS PEPTIZER FOR SILVER HALIDE EMULSIONS

[75] Inventors: John D. Lewis; Mark A. Whitson, both of Webster; Thomas J. Dannhauser, Pittsford; Tienteh Chen, Penfield; Pranab Bagchi, Webster, all of N.Y.

[73] Assignee: Eastman Kodak Company, Rochester, N.Y.

[21] Appl. No.: 1,361

[22] Filed: Jan. 7, 1993

[51] Int. Cl.[6] ..... G03C 1/005

[52] U.S. Cl. ..... 430/569; 430/567; 430/138; 430/627; 430/628; 430/642; 430/571; 430/545

[58] Field of Search ..... 430/567, 138, 627, 628, 430/642, 571, 569, 545

[56] References Cited

U.S. PATENT DOCUMENTS

| | | | |
|---|---|---|---|
| 2,618,553 | 11/1952 | Baines et al. | 430/569 |
| 2,698,796 | 1/1955 | Chechak et al. | 430/545 |
| 2,698,797 | 1/1955 | Godowsky et al. | 430/569 |
| 2,763,552 | 9/1956 | Van Campen et al. | 430/545 |
| 3,782,953 | 1/1974 | Maley | 430/569 |
| 3,816,129 | 6/1974 | Fitzgerald | 430/569 |
| 4,241,173 | 12/1980 | Saleck et al. | 430/569 |
| 4,801,524 | 1/1989 | Mifune et al. | 430/569 |
| 4,855,219 | 8/1989 | Bagchi et al. | 430/628 |
| 4,865,940 | 9/1989 | Schranz et al. | 430/138 |
| 4,877,720 | 10/1989 | Sato et al. | 430/627 |
| 4,885,219 | 12/1989 | Miller | 429/96 |
| 4,903,558 | 2/1990 | le Duc | 81/416 |
| 4,920,004 | 4/1990 | Bagchi | 430/138 |
| 5,026,632 | 6/1991 | Bagchi et al. | 430/545 |
| 5,055,379 | 10/1991 | Bagchi et al. | 430/289 |
| 5,066,572 | 11/1991 | O'Connor et al. | 430/503 |
| 5,073,472 | 12/1991 | Yamamoto | 430/138 |
| 5,091,296 | 2/1992 | Bagchi et al. . | |

FOREIGN PATENT DOCUMENTS

| | | |
|---|---|---|
| 61-236539 | 10/1986 | Japan . |
| 676459 | 7/1952 | United Kingdom . |

*Primary Examiner*—Thomas R. Neville
*Attorney, Agent, or Firm*—Paul A. Leipold

[57] ABSTRACT

This invention describes the use of gelatin-grafted-polymer particles as peptizers for the preparation of silver halide photographic emulsions, whereby the gelatin-grafted-polymer particles remain attached to the AgX crystals after preparation of the emulsions. In an embodiment of this invention, the core polymer particles are loaded with photographically useful agents. When the photographic agent is a dye-forming coupler, multicolor mixed-packet systems can be constructed using the packet emulsions prepared in the manner of this invention.

17 Claims, 6 Drawing Sheets

GELATIN-GRAFTED-POLYMER PARTICLES AS PEPTIZER FOR SILVER HALIDE EMULSIONS

FIELD OF INVENTION

This invention deals with the preparation of silver halide photographic emulsions by a controlled precipitation method using gelatin-grafted-polymer particles as the peptizer for the emulsion crystals.

BACKGROUND OF THE INVENTION (RA-1) T. H. James, "The Theory of the Photographic Process," 4th Edition, New York (1977).

(RA-2) K. R. Hollister and E. J. Perry, U.S. Pat. No. 3,813,251 (1974), describes the preparation of AgX grains using thioether group containing acrylate copolymers; M. J. Fitzgerald, "Synthetic Silver Halide Emulsion Binders," U.S. Pat. No. 3,816,129 (1974).

(RA-3) P. Bagchi, "Gelatin-Grafted-Polymer Particles," U.S. Pat. No. 4,920,004 (1990).

(RA-4) P. Bagchi, M. D. Steman, and H. M. Low, "Photographic Element Having Polymer Particles Covalently Bonded to Gelatin," U.S. Pat. No. 4,855,219 (1989); K. M. O'Conner, R. P. Szajewski, and P. Bagchi, "Control of Pressure-Fog with Gelatin-Grafted and Case-Hardened Gelatin-Grafted Soft Polymer Particles," U.S. Pat. No. 5,066,572 (1991 ); P. Bagchi, R. F. Reithal, T. J. Chen, and S. Evans, "Photoresist Dichromate Composition Containing Gelatin Coated Particles," U.S. Pat. No. 5,055,379 (1991).

(RA-5) P. Bagchi, "Theory of Stabilization of Spherical Colloidal Particles by Nonionic Polymers," J. Colloid and Interface Science 47, 100 (1974).

(RA-6) P. Bagchi and W. L. Gardner, "Use of Gelatin-Grafted and Case-Hardened Gelatin-Grafted Polymer Particles for Relief from Pressure Sensitivity of Photographic Products," U.S. Pat. No. 5,026,632 (1991).

(RA-7) W. Schmidt, "Photographic Material," U.S. Pat. No. 4,973,547 (1990); S. A. King and J. E. Maskasky, "Modified Peptizer Twinned Grain Silver Halide Emulsions and Process for Their Preparation," U.S. Pat. No. 4,942,120 (1990).

(RA-8) T. J. Chen, Describes loading of photographically useful compounds into latex particles for delivery in photographic coating, U.S. Pat. No. 4,199,363 (1980).

(RA-9) P. Bagchi, S. J. Sargeant, J. T. Beck, and B. Thomas, "Polymer Co-Precipitated Coupler Dispersion," U.S. Pat. No. 5,091,296 (1992).

(RA-10) H. Bains, E. P. Davey, and E. T. Teal, U.S. Pat. No. 2,618,553 (1946) describes a mixed-packet color photographic process.

(RA-11) P. Bagchi, B. V. Gray, and S. M. Bisnbaum, "Preparation of Model Polyvinyltoluene Latexes and Characterization of Their Surface Charge by Titration and Electrophoresis," J. Colloid and Interface Science 69, 502 (1979).

(RA-12) H. G. Curme and C. C. Natale, J. Phys. Chem. 63, 3009 (1964). (RA-13) K. Sato, S. Ohno, and S. Yamada, "Silver Halide Photographic Material," U.S. Pat. No. 4,877,720 (1989).

(RA-14) N. Sujimoto, T. Kojima, and Y. Mukunoki, "Silver Halide Photographic Light-Sensitive Material," U.S. Pat. No. 4,464,462 (1984).

(RA-15) A. G. Van Paesschen, "Polymerization of Monomeric Couplers," U.S. Pat. No. 4,080,211 (1978).

(RA-16) J. J. Chechak and S. S. Firke, "Resin Salt of Couplers in Mixed-Packet Photographic Emulsions," U.S. Pat. No. 2,698,796 (1955).

(RA-17) L. Godowsky and L. M. Minsk, "Mixed-Packet Photographic Emulsions Using Resin Couplers," U.S. Pat. No. 2,698,797 (1955).

(RA-18) J. H. Van Campen and J. W. Gates, "Modifiers for Photographic Packet Emulsions," U.S. Pat. No. 2,763,552 (1956).

(RA-19) V. Tulagin and R. D. Jackson, "Mixed-Packet Photographic Emulsions," U.S. Pat. No. 2,965,484 (1960).

(RA-20) L. Godowsky, "Mixed-Packet Photographic Emulsions," U.S. Pat. No. 2,698,794 (1955).

(RA-21) K. W. Schranz, "Photographic Recording Material," U.S. Pat. No. 4,865,940 (1989).

(RA-22) A. G. E. Mignot, "Silver Halide Precipitation Process with Deletion of Materials," U.S. Pat. No. 4,334,012 (1982).

(RA-23) S. Urabe, "Process for Preparing Silver Halide Grains," U.S. Pat. No. 4,879,208 (1989).

(RA-24) J. C. Cohen, W. L. Gardner, and A. H. Herz, Adv. Chem. Ser. 45, 198 (1973).

(RA-25) A. Holland and A. Fieinerman, J. Appl. Photogr. Eng. 8, 165 (1982).

(RA-26) Anonymous, "Photographic Silver Halide Emulsions, Preparations, Addenda, Processing, and Systems," Research Disclosure 308, p. 993, December 1989.

Traditionally, various types of gelatin have been used for the precipitation of photographic silver halide emulsions. Various synthetic water soluble polymers have also been found to be useful in the precipitation of photographic silver halide emulsions (RA-2). Hollister and Perry describe a variety of such water soluble polymers that contain pendent thioether groups, that are particularly suitable for the precipitation of Ag-halide photographic emulsions (RA-2). Gelatin-grafted-polymer particles have been described recently (RA-3). Gelatin-grafted-polymer particles are polymer particles with a monomolecular layer of gelatin chemically bonded to the polymer particles. Such particles have been particularly useful for use as matting agents, and agent for the relief of pressure sensitivity of photographic layers, and in the fabrication of color filter arrays (RA-4). In any colloidal peptization by steric stabilization, the most important parameter that governs the stability of a dispersion or an emulsion is the thickness of the protective stabilizer layer (RA-5) around the particle. A thicker adsorption layer causes a larger distance between the particles, stabilizing them from coagulation due to the decreased van der Waals attraction between the particles.

Many types of synthetic peptizers have been used in the preparation of AgX crystals. The most useful synthetic compositions have been those that contain thioether moieties (U.S. Pat. No. 3,813,251). Because of the necessity of higher and higher speeds of photographic emulsions (particularly in tabular grain emulsions) the silver halide crystals used in photographic systems today are getting bigger and bigger. Therefore, for their colloidal protection thicker protective adsorption layers are desirable. Various derivatized gelatins, meaning gelatin chemically bonded to organic molecules and water soluble polymeric molecules, have also been used to prepare photographic emulsions (RA-7).

Gelatin being a polyelectrolyte with an isoelectric pH (IEP), the adsorption layer thickness of the gelatin on a particle surface depends on the pH and the ionic strength (RA-4 and RA-5). Under low electrolyte conditions, which is the most favorable condition for colloidal stability, the thickness of the gelatin layer may vary anywhere from 10 to 60 nm. Under silver halide precipitation conditions, where the electrolyte concentration is very high, the smaller value is expected as the adsorbed polyelectrolyte would have the most compact structure under such conditions, which is detrimental to colloidal stability. FIG. 1 shows a pictorial view of a gelatin-grafted-polymer particle, where the bonded gelatin layer will also have the kind of dimension as described above. A further description of gel-g-latex particles can be found in (RA-6). It is also disclosed in (RA-3) and (RA-4) that the inner core polymer particles of a gel-g-polymer particle can be prepared with a diameter anywhere between 10 to $10^6$ nm.

PROBLEM TO BE SOLVED BY THE INVENTION

There is a need for peptizers that will provide improved colloidal stability of silver halide emulsions. Further, there is a need for peptizers that will allow for improved delivery of useful photographic agents close to the surface of the silver halide emulsion particle.

SUMMARY OF THE INVENTION

An object of this invention is to overcome disadvantages of prior emulsion-forming techniques.

An additional object of this invention is to provide photographic emulsions of improved colloidal stability.

An additional object of the invention is to provide improved delivery of photographic agents to the surface of silver halide particles.

These and other objects of the invention are generally accomplished by providing silver halide crystals with adsorbed gelatin-grafted polymer particles surrounding the silver halide crystals.

In another embodiment of the invention a method of forming photographic silver halide emulsions using gelatin-grafted polymers as a peptizer provides a dispersion of gelatin-grafted polymer particles into which is directed a flow of aqueous solution of soluble silver salt and halide salt with agitation to form photographic silver halide crystals with gelatin-grafted polymer particles attached to the surface of the silver halide crystal particles.

In another preparation method the dispersion of gelatin-grafted polymer particles is combined with a water soluble silver salt solution and a water soluble halide salt solution and mixed with agitation to form silver halide particles with the gelatin-grafted polymer particles attached to the surface of a silver halide crystal particles.

The invention also provides a photosensitive photographic element utilizing the silver halide crystal particles with gelatin-grafted polymer particles attached to the surface of the silver halide particles.

ADVANTAGEOUS EFFECT OF THE INVENTION

The invention has numerous advantages over prior photographic products and processes for their production. The invention provides more stable photographic products as the silver halide emulsion grains are provided with a thicker (compared with gelatin) layer of gel-grafted polymer particles that may contain photographically active materials. These photographically active materials are in close association with the silver halide particles and therefore can readily react during photographic processing. Further, such materials, being surrounded by a thick gelatin layer, are colloidally stable. The ability to mix different spectrally sensitized silver halide grains that are surrounded by complementary dye forming coupler particles corresponding to the spectral sensitization of the emulsion grains allows mixing in one silver halide layer of a photographic element, packets of magenta, cyan and yellow dyes with development only of the coupler that is bound to the particular sensitized crystal. This allows formation of mixed packet silver halide coatings that are inherently inexpensive to manufacture. The large particles containing coupler adsorbed onto the silver halide surface can allow a higher milo of dye to coupler compared to conventional silver halide photographic materials. In conventional imaging the silver halide grain is peptized by a water soluble polymeric molecule, usually gelatin. The invention also provides a close proximity of various photographically active materials such as ultraviolet absorbing agents, developing agents, and oxidized developer scavenging agents to the silver halide particles, thereby providing more effective use of such materials.

Another advantage is that the materials of the invention where the silver halide crystals having gelatin-grafted soft polymer particles adhered to their surfaces can be less pressure sensitive than conventional silver halide photographic materials. These and other advantages will be apparent from the detailed description of the invention below.

The invention has the advantage that photographically useful agents are efficiently delivered to the silver halide particle surface. This results in enhanced performance of such agents with the silver halide particle. A thicker layer of peptizer is formed on the silver halide particle, therefore, leading to better colloidal stability of silver halide emulsions that are stabilized with the gel-grafted particles of the invention. Further, there are advantages in the ability to associate photographically active materials directly with the surface of the silver halide emulsion particles. It allows particular couplers to be associated with specific grains of a photographic emulsion, thereby allowing a single layer having a mixture of packets with different color-forming couplers adhered to differently sensitized silver halide crystals to be formed to form color images from only a single layer.

DETAILED DESCRIPTION OF THE INVENTION

This invention uses gelatin-grafted-polymer (gel-g-polymer) particles to precipitate and peptize silver halide emulsion crystals producing gel-g-polymer particles adsorbed (attached) to silver halide emulsion crystals to produce a stable photographic emulsion system.

This invention produces a thick adsorption layer of the gel-g-latex particles, around the peptized silver halide particles, that is suitable for stabilizing and peptizing large silver halide crystals either cubic, octahedral, spherical, or tabular grain types.

This invention provides photographic agents such as filter dyes, development inhibitor release couplers, development inhibitor anchimeric release couplers, dye-forming couplers, nucleators, ultraviolet radiation absorbing materials, development boosters, developers, sensitizing dyes, and various photographic agents close to the silver halide crystal surface by incorporating or loading such agents into the polymer particles before gel grating and emulsion precipitation that results in the photographic agent being in close contact with the silver halide particle surface.

This invention also provides photographic agents such as polymeric-filter dyes, development inhibitor-release couplers, development inhibitor anchimeric release couplers, dye-forming couplers, nucleators, ultraviolet absorbing materials, development boosters, developing agents, oxidized developer scavenging agents, sensitizing layers, and various polymeric photographic agents close to the silver halide crystal surface by grafting gelatin to such polymeric photographic agent latex particles and then precipitating the silver halide crystals using such gel-grafted polymeric particles containing the photographic material, as the peptizing agent or agents.

Figure 2:
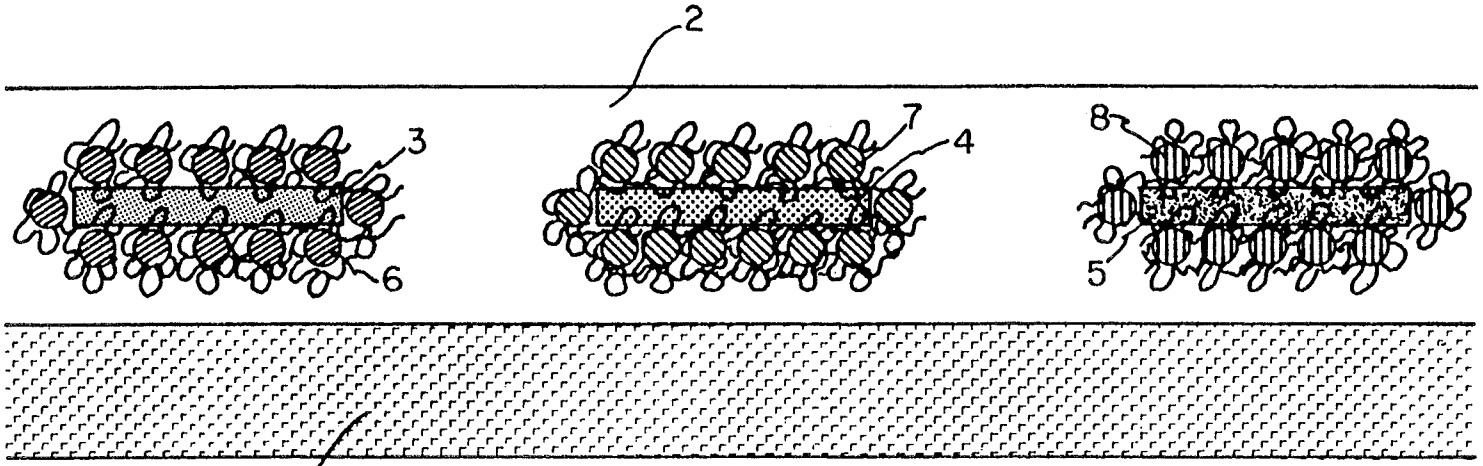
FIG. 2. Conceptual depiction of a three color mixed-packet color photographic element achieved by the method of this invention. 1-base; 2-mixed-packet element; 3-red sensitized silver halide crystal; 4-green sensitized silver halide crystal; 5-blue sensitized silver halide crystal; 6-gel-g-cyan polymeric coupler particle or gel-g-cyan coupler loaded polymeric particle; 7-gel-g-magenta polymeric coupler particle or gel-g-magenta coupler loaded polymer particle; 8-gel-g-yellow polymeric coupler particle or gel-g-blue coupler loaded polymer particle.

This invention provides materials for the construction of a high resolution mixed-packet color photographic system by using gel-grafted-polymeric dye-forming coupler particles or dye-forming coupler loaded latex particles to produce emulsion crystals that have color sensitivity complementary to the dye-forming coupler attached to crystals to form individual packet emulsions for a single layer, mixed-packet color photographic coating as pictorially indicated in FIG. 2.

This invention provides silver halide crystals with adsorbed or attached gel-g-soft polymer particles to produce less pressure sensitive photographic elements prepared using gel-grafted soft latex precipitated silver halide crystals. It is believed that attached soft gel-g-latex particles will provide better pressure sensitivity relief compared to unattached particles in the coating.

Figure 1:
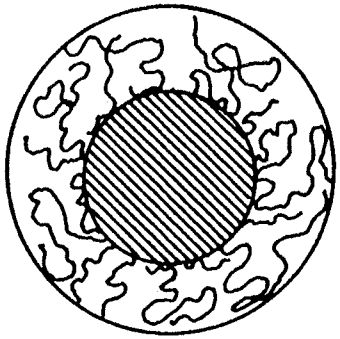
FIG. 1. Gelatin-grafted-polymer particle.

When gel-g-polymer (gelatin-grafted-polymer) particles with no excess gel in solution (meaning all gel bound to the particle) are used to precipitate silver halide emulsions, it is expected that the whole gel-g-latex particle as shown in FIG. 1 would act as a very large gelatin molecule and attach to the silver halide particle surface. Since the core diameter of the latex can be varied over a wide range of sizes it will be possible to peptize and protect from coagulation preparations of very large size silver halide particles. This is because the effective protective adsorption layer thickness around the silver halide particle will be equal to the core particle diameter plus twice the gel adsorption layer thickness of the particle. In other words, essentially very large thicknesses of this gel-g-latex layer around the silver halide grains can be formed. Such adsorbed gel-g-latexes should be visible by electron microscopy to be attached to the silver halide crystal surface.

The preparation of gelatin-grafted-polymer particles has been extensively described earlier (RA-3, RA-4, and RA-6) and those publications are hereby incorporated herein by reference. The preparation of gelatin-grafted latex particles is also shown in the examples below. Of particular importance to this invention are the gel-g-polymer particles that have been prepared such that there is no excess gelatin remaining in solution of the gel-g-latex system. In other words, the gel-g-latex samples that are useful for this invention have all the gelatin molecules bound to the polymer particle surface. Therefore, the amount of gelatin to be used depends upon the specific surface area (S) of the latex particles. The specific surface area of polymer particles depend upon the mean particle diameter of the particle (D). S is given by $$S=6\rho/D \quad (1)$$

where $\rho$ is the density of the polymer particle. The saturation adsorption of gelatin depends upon the pH and ionic strength of the solution. However, as a general rule the saturation adsorption of 10 mg/sq m of surface is a reasonable estimate (RA-12 and RA-9). The gel-g-polymer particles of this invention are those that have been prepared at gelatin coverages that are less than 10 mg of gelatin per sq m of the polymer particle surface and preferably below 8 mg of gelatin per sq m of the polymer particle surface.

Generally the invention is accomplished by providing gel-grafted particles that are bound to the surface of silver halide particles. The gel-grafted polymer particles are preferably photographically active or useful materials, such as couplers. These photographically active or useful dispersions of particles may be formed by a process that is disclosed in U.S. Pat. No. 4,920,004 (Bagchi et at.) and U.S. Pat. No. 5,055,379 (Bagchi et al.) hereby incorporated by reference. Generally this process involves formation of polymer particles by emulsion polymerization, suspension polymerization, or limited coalescence. The gelatin is then monomolecularly bonded to the surface of these particles by direct chemical reaction or by the use of a chemical grafting agent. A gelatin grafting agent is a chemical compound that will allow bond formation between gelatin and a chemical moiety on the surface of the polymer particle. Typical of such chemical grafting materials suitable for the invention are carbamoylonium compounds, dication ether compounds, and carbodiimide compounds.

The gelatin grafted polymers of this invention are photographically active or useful materials that when present during the formation of silver halide particles result in the silver halide particles or crystals having these materials adsorbed to their surface. It is possible that a container may be provided with a solution of silver halide and dispersed therein the gelatin grafted polymers. Then a halide salt is added to precipitate silver halide particles that will have adhered to their surface the photographically active or useful gel grafted particles. Then in the alternative is also possible that the solution initially just be a dispersion of the photographically active useful particles to which is added simultaneously the silver salt and the halide salt. Alternatively, it is possible that the silver salt could be initially provided with a dispersion of photographically useful particles and then the halide salt added to the solution with agitation such that the silver halide particles having surface adsorbed gelatin grafted polymers are formed.

These silver halide particles having gelatin grafted polymers adhered to their surface may be utilized in generally conventional photographic materials as well as in the mixed packet photographic elements that are described in more detail below. The use of silver halide particles having bonded to their surface the photographically active or useful materials simplifies formation of layers of materials as the mixing of fewer materials prior to photographic element formation is necessary as photographic materials such as couplers have been adhered to the emulsion during silver halide formation.

Chemical reactions suitable for the preparation of gelatin-grafted-polymer particles are extensively described in (RA-3, RA-4, and RA-6) and are hereby incorporated herein by reference. The preparation is also described in the examples below.

The chemical compositions of the core polymer particles have also been described extensively in (RA-3, RA-4, and RA-6) and are hereby incorporated herein by reference. The core polymer particle of the gel-g-latex of this invention can be loaded with one or a combination of the following types of photographic agents by the method described by Chen (RA-8) or that of Bagchi et al. (RA-9):

a. Filter Dyes,
b. Development Inhibitor Release Couplers,
c. Development Inhibitor Anchimeric Release Couplers,
d. Dye-Forming Couplers,
e. Nucleators,
f. Development Boosters,
g. Ultraviolet Radiation Absorbing Compounds,
h. Sensitizing Dyes,
i. Development Inhibitors,
j. Antifoggants,
k. Bleach Accelerators, etc.

Attachment of photographic agents to silver halide particle surfaces in many cases can improve the colloidal stability of the photographic emulsion.

The chemical compositions of the core polymeric photographic agent particles, useful for this invention, have been described extensively in related arts (RA-4, RA-13, RA-14, and RA-15), and are included herein by reference. Typical polymeric core photographic agent particles suitable for this invention are as follows:

a. Polymer Filter Dye Particles,
b. Polymeric Development Inhibitor Release Coupler Particles,
c. Polymeric Development Inhibitor Anchimeric Release Coupler Particles,
d. Polymeric Dye-Forming Coupler Particles,
e. Polymeric Ultraviolet Radiation Absorbing Compound Particles,
f. Polymeric Development Booster Particles,
g. Polymeric Developer Particles,
h. Polymeric Sensitizing Dye Particles,
i. Polymeric Development Inhibitors,
j. Polymeric Antifoggants,
k. Polymeric Bleach Accelerators, etc.

Attachment of photographic agents to the silver halide surfaces can improve the photographic performance of photographic products, in many cases.

A mixed-layer color photographic system is one in which a single photographic layer is made up of silver halide grains with different spectral sensitizations. The manufacturing benefit of such a system is clear: reduction of the number of layers in a color photographic system. The ability to collapse differently sensitized layers (different by color or by speed) can lead to cost savings.

There are two kinds of mixed-layer color photographic systems. The system in which differently sensitized silver halide emulsion grains are mixed together in a single layer without incorporation of the corresponding image-forming dye components (couplers) is generally called a mixed-grain coating.

The second type of mixed-layer system also contains differently sensitized silver halide emulsion particles but in addition contains different image-forming dye components associated with the silver halide sensitized for each region of the spectrum. The particles that are mixed may or may not be individual silver halide grains. In many coatings of this kind, silver halide grains of a certain sensitivity and the appropriate image-forming dye or dye component are both dispersed in a colloidal vehicle; this vehicle with its contents is then dispersed as globules in a continuous phase or "matrix" consisting of a second colloid vehicle not compatible with the fast. A mixture of two or more such dispersions containing particles of different spectral sensitivity is commonly called a mixed-packet coating. However, there are other materials in which image-forming dyes or dye components are intimately associated with the color-sensitized silver halide grains themselves, as by adsorption or complex formation, and the grains are mixed in a single emulsion vehicle. Such materials are also considered mixed-packet materials.

The processing of mixed-packet materials is usually simpler than that of mixed-grain materials. This is the result of associating the proper image-forming dye or dye component with the silver halide sensitized for each region of the spectrum. A single chemical step can suffice, therefore, to form all the dye images, each under the control of the proper set of silver or silver halide grains. On the other hand, mixed-grain materials usually require not only the original exposure to the subject, but also two or more reversal exposures to light of different colors, each followed by a reversal development in a different color developer solution containing a soluble coupler to introduce the three dye components (couplers) one after another and to form the three dye images, each under the control of the proper set of differently sensitized grains.

Because of the potential commercial value of an acceptable quality mixed-packet system, extensive work has been done as indicated in the prior art references (RA-16 through RA-21 ).

The silver halide emulsion precipitation, by the method of this invention, allows the attachment or adsorption of gel-g-polymeric dye-forming coupler particles or gel-g-dye-forming coupler loaded polymer particles to the silver halide crystals. Therefore, the dye-forming coupler by the method of this invention is intimately associated with the silver halide particles. Preparation of red sensitized silver halide crystals using gel-g-cyan coupler particles, green sensitized silver halide crystals using gel-g-magenta coupler particles, and blue sensitized silver halide crystals using gel-g-yellow coupler particles and coating them in a single layer as shown in FIG. 2 can provide a high resolution mixed-packet color photographic system. The resolution would be high as the pack emulsion is formed by single coupler particle covered silver halide grains.

It is known that the incorporation of gel-g-soft polymer particles in photographic layers with silver halide emulsions can vastly improve the pressure sensitivity of photographic film products, without hindering developability of the photographic film (RA-4 and RA-6). This is an advantage over incorporation of simple soft polymer particles in a photographic layer which causes development inhibition due to coalescence of the particles. It is conceived, therefore, that a layer of soft gel-g-latex particles attached to the silver halide grain surface will provide enhanced and improved pressure sensitivity of photographic emulsion crystals, especially for highly pressure sensitive thin tabular grain emulsions.

Various types of methods used in the preparation of photographic silver halide emulsions have been described in detail in prior art references (RA-1, RA-22, and RA-23). The precipitation technique of this invention may involve a Ag salt run into a halide solution containing gel-g-latex particles, pAg-controlled double jet rim of $Ag^+$ and $X^-$ (halide) into a kettle containing gel-g-polymer particle dispersion, or a process where nucleation and growth are carded out continuously or semi-continuously in two separate concentration stages as described in (RA-22) and (RA-23). In the process of this invention the gelatin is simply replaced with gel-g-polymer particles or gel-g-polymeric photographic agent particles or gel-g-photographic agent loaded polymer particles. The emulsion may be a AgCl, AgBr, AgI, AgCl(Br), AgCl(I), AgClBr(I), or AgBr(I) emulsion. The weight of gel-g-polymer particle used for precipitation of the emulsions by the method of this invention depend on the crystal morphology or shape of the emulsion crystals to be prepared and their sizes. It may range from 5 g of gel-g-polymer particle to 200 g of gel-g-polymer particle per mole of the Ag halide emulsion prepared. The emulsion particles may be cubic, octahedral, rounded octahedral, polymorphic, tabular or thin tabular emulsion grains. Such silver halide grains could be regular untwined, regular twined, or irregular twined with cubic or octahedral face. The gelatin and preparation of the gel-g-polymer particles may be a regular lime processed or acid processed ossein gelatin or various derivatized gelatins as described in related art (RA-1) and (RA-6). Gelatins such as phthalated, acetylated, or alkylated gelatins may be particularly useful in some embodiments of this invention.

EXAMPLES

The following examples are intended to be illustrative and not exhaustive of the invention. Parts and percentages are by weight unless otherwise mentioned. Coating laydowns are given in "mg/ft$^2$." Multiplication of these numbers by 10.7 will convert them to "mg/m$^2$." In some cases the "mg/m$^2$" numbers are also included within parentheses "()."

Example 1: Preparation of Poly(Styrene-co-Butyl Acrylate-co-Ethylene Glycol Dimethacrylate-co-Methacrylic Acid) Latex—Weight Ratio (37/37/2/24)

The latex was prepared by standard emulsion polymerization procedure (RA-11) as follows. A 5 L 3-neck round-bottom flask fitted with a condenser, an air stirrer and a supply for nitrogen under low blanketing pressure was charged with 4 L of nitrogen purged distilled water. The flask was placed in a constant temperature bath (CTB) at 60° C. After temperature equilibration 0.4 g of sodium dodecylsulfate surfactant was added to the reaction flask and a mixture of the following monomers:

| | |
|---|---|
| Styrene | 148 g |
| Butylacrylate | 148 g |
| Methacrylic Acid | 96 g |
| Ethylene Glycol Dimethacrylate | 8 g |
| Total | 400 g |

Figure 3:
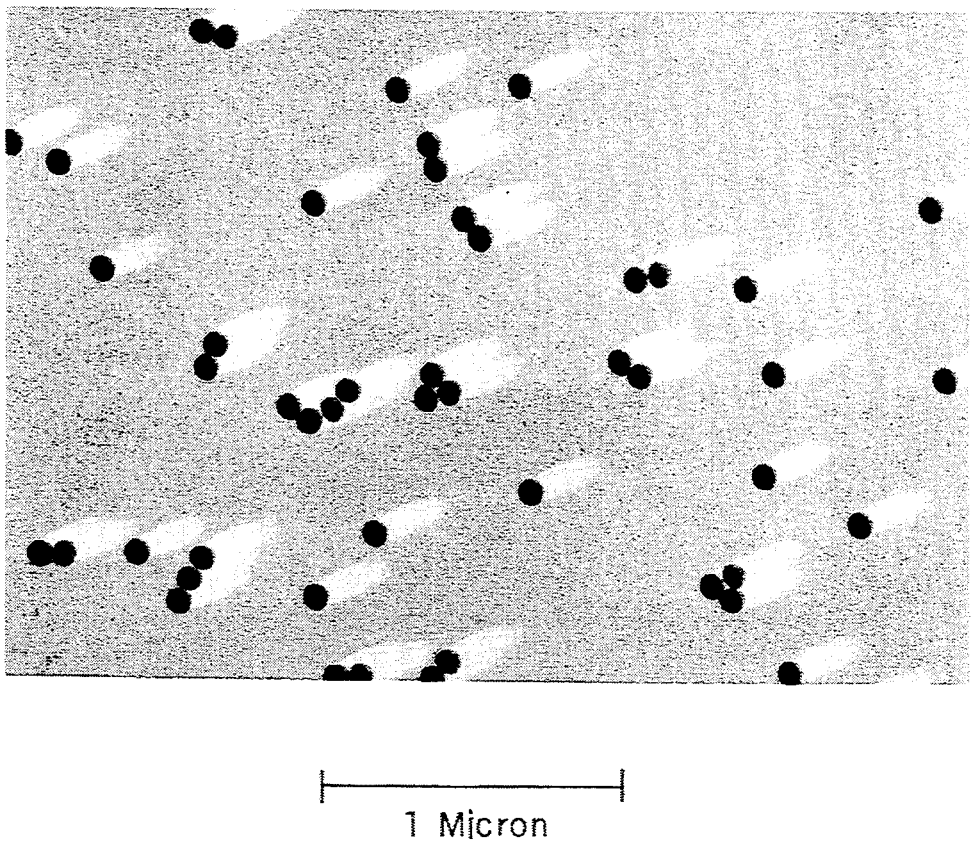
FIG. 3. Shadowed electron photomicrograph of latex of Example-1.

To the formed emulsion was added 8 g of $(NH_4)_2S_2O_8$ and 4 g of $Na_2S_2O_5$. The polymerization reaction was carried out for 18 h at 60° C. The latex was dialyzed against distilled water for 24 h in a continuous dialysis set up. The dialyzed latex had a solids contrast of 8.4%. The particle size of the latex was measured by photon correlation spectroscopy to be 80 nm. FIG. 3 shows a representative shadowed electron photomicrograph of the latex particles. They appear to be indeed around 80 nm. This latex is designated as Latex (Example-I).

Example 2: Preparation of Gel-g-Latex (Example-I) [35% Gel-IV]

Gelatin-grafted polymer particles described earlier (RA-3 and RA-4) were prepared with much larger excess of gelatin than that needed to saturate the surface of the particles. However, in order to use gelatin-grafted polymer particles to precipitate emulsions, it is necessary to prepare gel-g-latex particles with no excess gelatin remaining in solution such that the AgX grains do not have a chance of being peptized by unattached gelatin molecules and that gel-g-latex particles are the only peptizing units that adsorb to the surface. Therefore, all gelatin-grafting procedures in this work were carried out with less gelatin than that necessary to completely cover the surface.

Gelatin adsorption has been extensively studied by Curme et al. (RA-12) on Ag-halide surfaces. As expected for polypeptides that contain —COOH and —$NH_2$ groups, this adsorption excess is highly dependent on pH and ionic strength. An estimate for use in synthetic work is about 10 mg of gelatin adsorbed at saturation per sq meter of surface. The latex of Example 1 with a diameter of 80 nm has a surface area of 75 m$^2$/g. Therefore for 75% coverage of surface, we need about (75 m$^2$/g$\times$0.75$\times$0.01 g/m$^2$)=0.56 g of gelatin per gram of the dry latex polymer. In other words, in the dry gel-g-latex polymer there will be [(0.56/1.56)$\times$100]=35% gelatin.

Based upon the above analysis, gelatin grafting to the latex of Example 1 was carried out as follows. 1190 g of the latex of Example 1 containing 100 g of dry polymer was adjusted to pH=8.0 using 20% NaOH solution and heated to 60° C. in 3-neck round-bottom flask. 52.9 g of deionized lime processed ossein gelatin (12.5% moisture) was dissolved in 500 g of water and heated to 60° C., and the pH was adjusted to 8.0 using 20% NaOH. 3.5 g of the gelatin grafting agent (I) (based upon 0.2 moles of (I) per mole of surface methacrylic acid, taken to be 5% of the polymer particle by weight) was added to the latex at 60° C. and stirred for 15 min. Then the gelatin solution at 60° C. was added to the latex dispersion and reacted for another 15 min. The gel-g-latex material was called gel-g-latex (Example I) [35% Gel-IV] and had a solid constant of 9.0%. However, samples for all photographic testing were dialyzed at 40° C. continuously against distilled water to remove the fragments generated in the grafting reaction. See reaction scheme.

The chemistry of gelatin-grafting to carboxylated particles is generally assumed to proceed according to any of the following pathways.

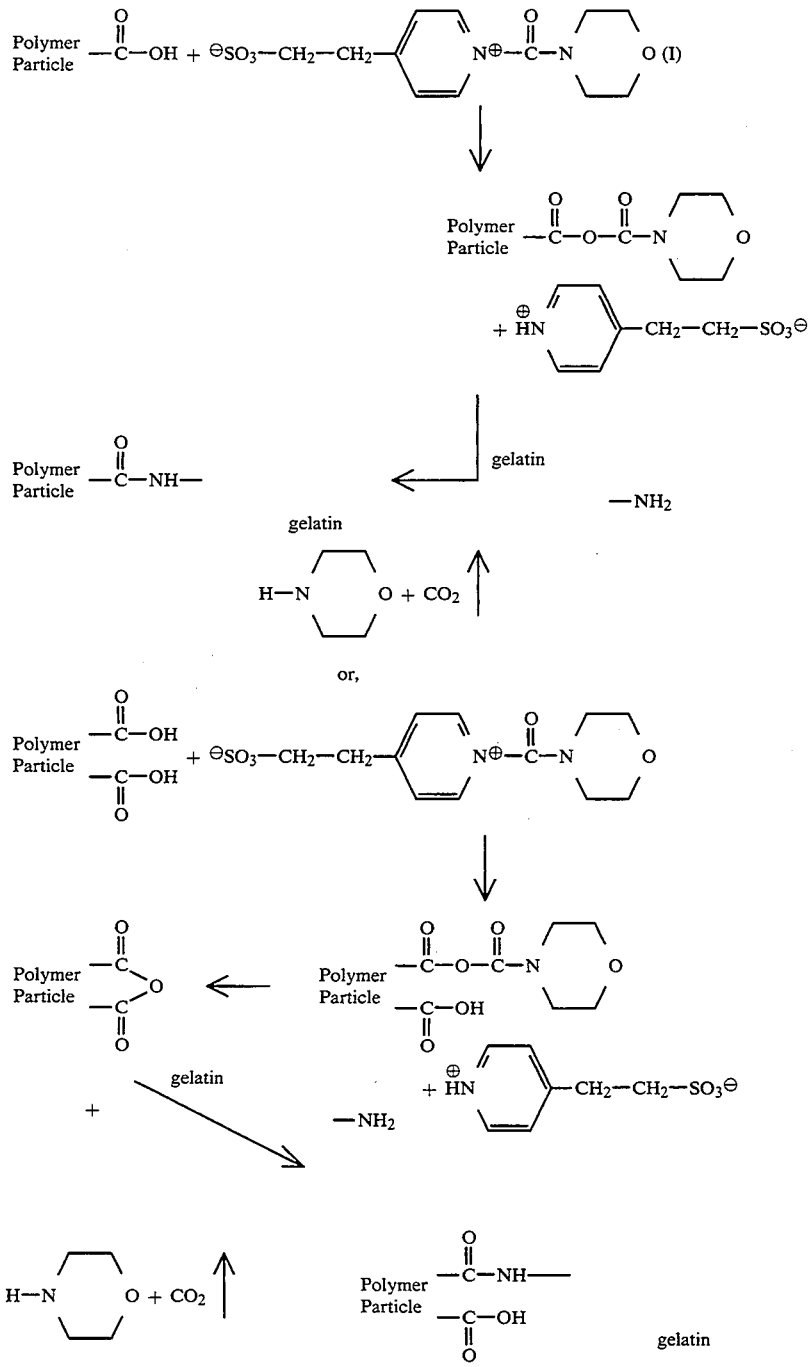

Examples 3 and 4: Preparation of Other Gelatin-Graftable Core Latexes

Latex samples containing the gelatin-graftable handle, methacrylic acid, were generally prepared the same way as that of Example 1. Table I shows specific details of the preparation of these latexes.

Examples 5 through 7: Grafting of Gelatin Onto the Latexes of Examples 3 and 4

Gel-g-latexes were prepared from the latexes listed in Table I, by generally the same procedure as described earlier in Example 2. The final compositions and surface coverages of the gel-g-latex samples are indicated in Table II. In all grafting, as before, 0.2 moles of compound I was used per mole of surface methacrylic acid (assumed 5% of total polymer weight). As seen in Table II, all gel-g-latexes were prepared at less than 100% surface coverage of gel in the latexes. All gel-g-latexes were stored in a refrigerator at 4° C.

TABLE I

Latex Preparations

| Latex ID | Latex Composition[1] | Reactor Size (L) | Distilled Water (L) | Monomer | Monomer Charge: Monomer Wt (g) | Monomer Charge: Initiator/Surfactant | Initiator Charge: Initiator/Surfactant Wt (g) | Initiator Charge: Reaction Temp. Deg. C. | Reaction Time (hr) | Dialysis Time (hr) | Final Solids % | Particle Diameter by PCS (nm) | Surface Area $m^2/g$ |
|---|---|---|---|---|---|---|---|---|---|---|---|---|---|
| Example 1 | ABCD (37/37/2/24) | 5 | 4 | A | 148 | $(NH_4)_2S_2O_8$ | 8 | 60 | 18 | 24 | 8.4 | 80 | 75 |
| | | | | B | 148 | $Na_2S_2O_5$ | 4 | | | | | | |
| | | | | C | 8 | SDS[2] | 0.4 | | | | | | |
| | | | | D | 96 | | | | | | | | |
| Example 2 | ABD (65/30/5) | 5 | 4 | A | 260 | $K_2S_2O_8$ | 8 | 60 | 17 | 0 | 9.6 | 58 | 103 |
| | | | | B | 120 | $NaS_2O_5$ | 4 | | | | | | |
| | | | | D | 20 | SDS | 4 | | | | | | |
| Example 3 | ABD (50/45/5) | 5 | 4 | A | 180 | $K_2S_2O_8$ | 2 | 60 | 24 | 0 | 9.1 | 98 | 51 |
| | | | | B | 200 | $K_2S_2O_5$ | 1 | | | | | | |
| | | | | D | 20 | SDS | 0.4 | | | | | | |

[1]Styrene - A, Butyl acrylate - B, Ethyleneglycoldimethacrylate - C, Methacrylic acid - D.
[2]SDS - Sodium dodecyl sulfate.

TABLE II

Gel-g-Latex Preparations

| Gel-g-Latex ID | Gel-g-Latex Composition | % Latex Surface Covered by Grafted Gelatin[1] | Gel-g-Latex Solids (%) |
|---|---|---|---|
| Example 2 | Gel-g-ABCD (37/37/2/24) [35% Gel-LP] | 75 | 9.0 |
| Example 5 | Gel-g-ABCD (37/37/2/24) [35% Gel-LP[3]) | 75 | 6.5[2] |
| Example 6 | Gel-g-ABD (65/30/5) [35% Gel-PA[4]] | 48 | 9.9 |
| Example 7 | Gel-g-ABD (50/45/5) [35% Gel-LP] | 98 | 9.3 |

[1]Saturation adsorption of gelatin was assumed to be 10 $mg/m^2$ (RA-12).
[2]Gel-g-latex dialyzed continuously against distilled water for 24 h at 40° C.
[3]LP - Lime processed ossein gelatin.
[4]PA - Phthalated gelatin as described in (RA-24) with 5.0 g bound phthalic anhydride per 100 g of dry gelatin.

Examples 8 through 12: Emulsion Preparations

All emulsions were prepared by the well known double-jet method of precipitation (RA-1). Several batches of AgCl emulsion were prepared using gel-g-latex sample to demonstrate that such a novel peptizer produces AgCl grains with attached gel-g-latex particles to the surface of the AgCl grains. The details of the individual preparations are described below.

Example 8: Precipitation of Cubic AgCl Emulsions Using Gel-g-Latex of Example 2

| | | |
|---|---|---|
| Make Kettle: | Gel-g-Latex of Example-2 | 900 g |
| | DI Water | 2100 g |
| | Temperature | 60° C. |

-continued

| | | |
|---|---|---|
| | Control Set Point | pAg = 7.55 |
| Silver Solution: | $AgNO_3$ | 5M |
| Salt Solution: | NaCl | 5M |

Double-jet precipitation of this AgCl emulsion was carried out by adding the silver and the salt solutions over a period of 39.9 min, controlling the temperature and the pAg to the set points. The initial silver flow rate was 22 mL/min ramped to 115 mL/min. The emulsion was cooled and stored at 4° C.

Figure 4:
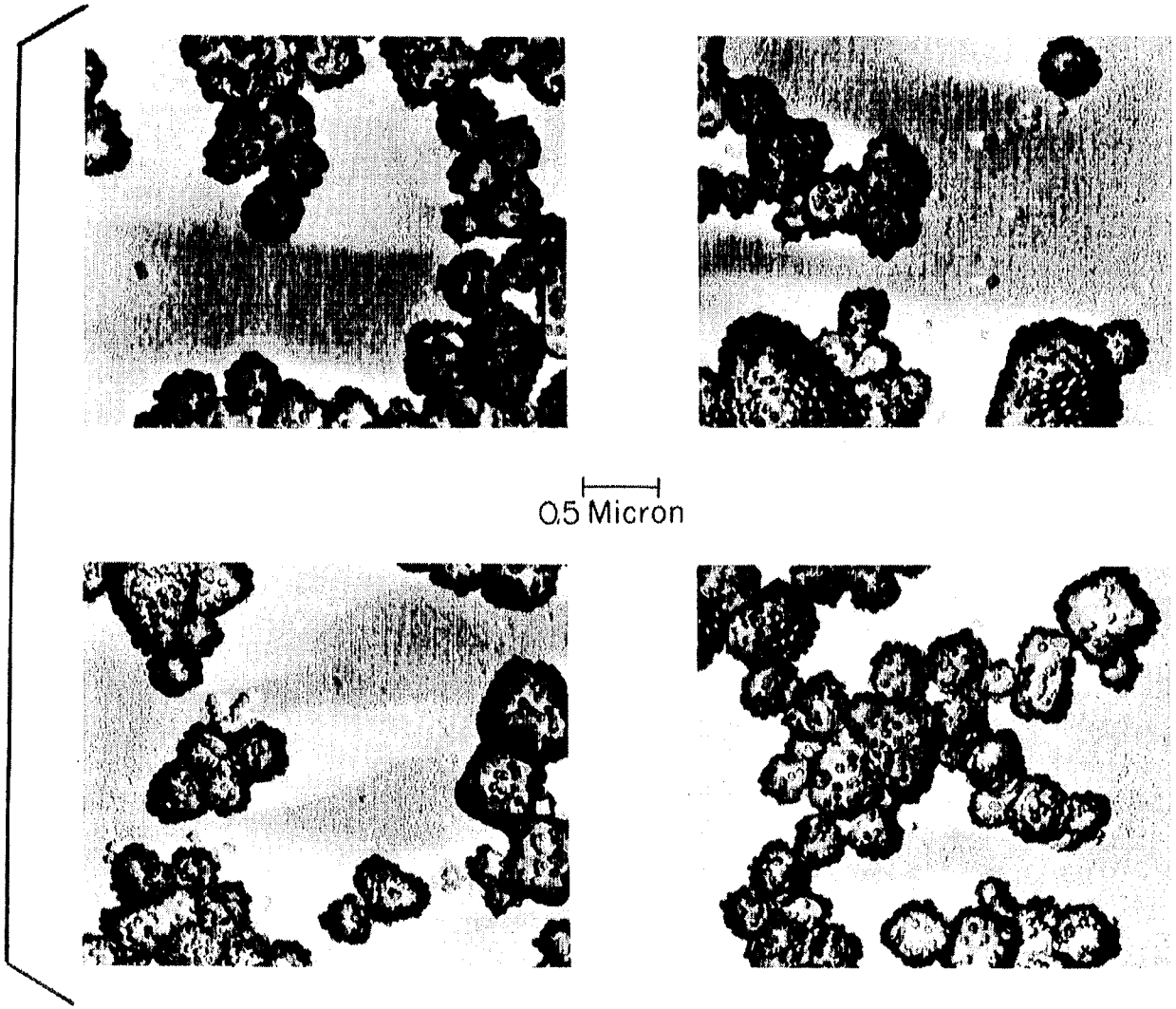
FIG. 4. Carbon shadowed electron photomicrographs of AgCl emulsion of Example-8, precipitated in the presence of gel-g-latex of Example-2.

FIG. 4 shows a set of carbon shadowed electron photomicrographs of the precipitated emulsion. It is observed that the grains are somewhat heterodisperse compared to known gelatin preparations (RA-1). It is clearly seen, however, that the gel-g-latex particles are attached to the surface of the AgCl grains as a peptizer should and there are only very few unattached gel-g-latex particles in the field of view of the four frames shown in FIG. 4. The average edge-length as determined by electrolytic grain analysis (EGA) was 511 nm, even though all the grains did not show perfect cubic behavior. For derailed description of EGA technique, see (RA-25).

Example 9: Precipitation of Cubic AgCl Emulsions Using Gel-g-Latex of Example 5

| | | |
|---|---|---|
| Make Kettle: | Gel-g-Latex of Example-5 | 500 g |
| | DI Water | 2500 g |
| | Temperature | 60° C. |
| | pH | 5.05 |
| | Control Set Point | pAg = 7.55 |
| Silver Solution: | $AgNO_3$ | 0.1M |
| Salt Solution: | NaCl | 0.4M |

Figure 5:
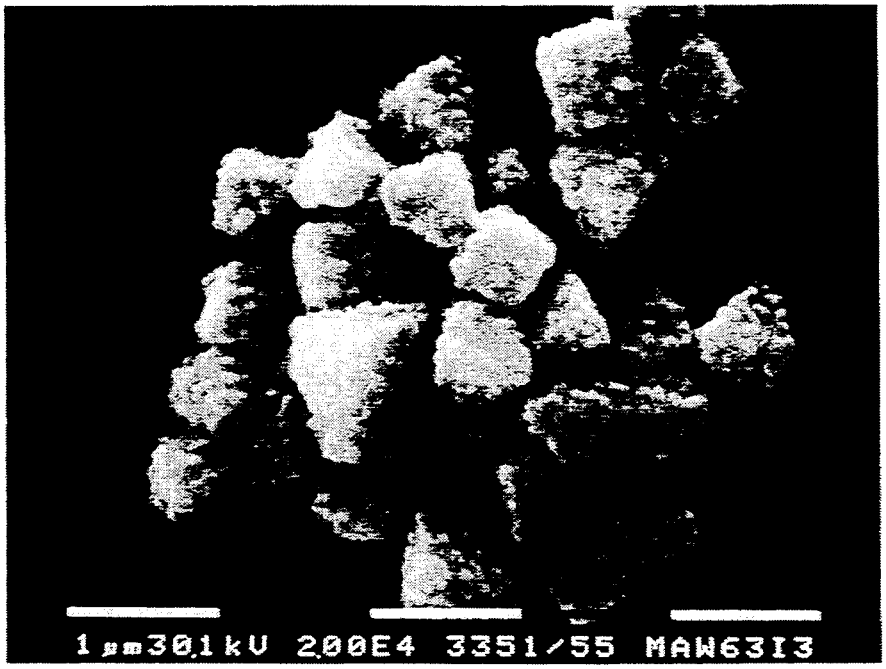
FIG. 5. Scanning electron photomicrograph of palladium/gold coated AgCl emulsion of Example-9, precipitated using gel-g-latex of Example-5.

Double-jet precipitation of this AgCl emulsion was carried out by adding the silver and the salt solution to the kettle over a period of 39.9 min controlling the temperature and the pAg to the given points. The initial silver flow rate was increased from 22 mL/min to 115 mL/min over a period of 13.25 min. After precipitation was complete, the pH of the emulsion was lowered to 3.80 with 4.0N $HNO_3$. The emulsion was allowed to settle. The supernatant was decanted and replaced with deionized water. The pH was adjusted to 5.0 with 2N NaOH. This cycle was repeated twice more. The concentrated emulsion was adjusted to a pH of 5.00 and a pAg 7.55. A sample was coated on a carbon scanning electron microscope stage and evaporation coated with palladium/gold for enhanced contrast of the gel-g-latex particles in the electron beam. FIG. 5 shows the scanning electron photomicrograph of the emulsion grains of this example. As in the case of the emulsion of Example 8, we see that in this preparation the gel-g-latex particles are attached to the AgCl crystal surface. The grains are slightly heterodisperse and not all grains are perfectly cubic, as seen in the case of Example 8. EGA analysis of the emulsion of this example indicated an average edge length of 453 nm.

Example 10: Precipitation of Cubic AgCl Emulsions Using Gel-g-Latex of Example 6

| | | |
|---|---|---|
| Make Kettle: | Gel-g-Latex of Example-6 | 1500 g |
| | DI Water | 2902 g |
| | Temperature | 60° C. |
| | Control Set Point | pAg = 7.09 |
| Silver Solution: | $AgNO_3$ | 4.5M |
| | $HgCl_2$ | 0.066 mg/Ag mole |
| Salt Solution: | NaCl | 4.5M |

Double-jet precipitation of this AgCl emulsion was carried out by adding the silver and the salt solution to the kettle over a period of 39.9 min controlling the temperature and the pAg to the given points. The initial silver flow rate was 22 mL/min ramped to 115 mL/min. The emulsion was cooled to 40° C. and the pH was adjusted to 3.8. The emulsion was iso-washed twice. 1286.2 g of Rousselot (lime processed ossein deionized) gelatin and 4.0 g of 4-chloro-3,5-xylenol were added and the emulsion was chill set for storage at 4° C. The average edge-length of the AgCl crystals was determined by EGA to be 384 nm. Photomicrograph of the emulsion showed the same characteristics as those of Examples 8 and 9, shown in FIGS. 4 and 5, respectively.

Example 11: Precipitation of Cubic AgCl Emulsions Using Gel-g-Latex of Example 7

| | | |
|---|---|---|
| Make Kettle: | Gel-g-Latex of Example-7 | 1500 g |
| | DI Water | 2902 g |
| | Temperature | 60° C. |
| | Control Set Point | pAg = 7.09 |
| Silver Solution: | $AgNO_3$ | 4.5M |
| | $HgCl_2$ | 0.066 mg/Ag mole |
| Salt Solution: | NaCl | 4.5M |

Double-jet precipitation of this AgCl emulsion was carded out by adding the silver and the salt solutions to the kettle over a period of 39.9 min controlling the temperature and pAg to the given set points. The initial flow rate was 22 mL/min, ramped to 115 mL/min. The emulsion was cooled to 40.0° C. and 3 kg of $Na_2SO_4$ dissolved in 6 L of water was added. The temperature was raised to 55° C. for 5 min and cooled to 35° C. The supernatant was decanted off. Such decant/wash was carded out five times with cold water. 1276.0 g of Rousselot gelatin, and 3.3 g of 4-chloro-3,5-xylenol were added to the emulsion and then it was chill set for storage at 4° C. The average edge-length of the AgCl crystals as determined by EGA was 418 nm. Photomicrograph of the emulsion showed same characteristics as those of Examples 8 and 9, shown in FIGS. 4 and 5, respectively.

Example 12: Precipitation of Cubic AgCl Emulsions Using Lime Processed Ossein Gelatin (Control)

| | | |
|---|---|---|
| Make Kettle: | Rousselot lime processed ossein deionized gelatin | 400 g |
| | Nalco Antifoam | 0.5 mL |
| | DI Water | 3692 g |
| | Temperature | 63° C. |
| | Control Set Point | pAg = 7.02 |
| Silver Solution: | $AgNO_3$ | 4.5M |
| | $HgCl_2$ | 0.071 mg/Ag mole |
| | $NHO_3$ | 0.024M |
| Salt Solution: | NaCl | 4.5M |

Double-jet precipitation of this AgCl emulsion was carried out by adding the silver and the salt solution to the kettle over a period of 39.9 min controlling the temperature and pAg to the given set points. The initial $Ag^+$ flow rate was 22 mL/min ramped to 115 mL/min. The emulsion was cooled to 43.3° C. and ultra-filtered to give an electrode voltage corresponding to pAg=6.51. 984.4 g of Rousselot gelatin and 3.4 g of 4-chloro-3,5-xylenol were added and the emulsion was chill set for storage at 4° C. Photomicrographs of this emulsion showed uniform cubic AgCl crystals as expected (RA-4). EGA analysis gave an arithmetic average edge-length of 411 nm. Table III shows a comparison of the sizes of all the various emulsions of this invention along with that of the control.

TABLE III

AgCl Emulsion Crystal Sizes

| AgCl Emulsion | Peptizer Used for Precipitation | Arithmetic Average Edge Length by EGA (nm) |
|---|---|---|
| Example 8 | Gel-g-latex of Example 2 | 511 |
| Example 9 | Gel-g-latex of Example 5 | 453 |
| Example 10 | Gel-g-latex of Example 6 | 384 |
| Example 11 | Gel-g-latex of Example 7 | 418 |
| Example 12 | Control Lime Processed Ossein | 411 |

Examples 13 through 15: Emulsion Finishing

In order to photographically test emulsions of Examples 10 and 11 precipitated using gel-g-latexes, these emulsions and the control gelatin-IV precipitated emulsion of Example 12 were finished by virtually the same procedure. The minor variations in the details can be noted in the following finishing formulae. These emulsions were all chemically sensitized with sulfur and gold and spectrally for blue sensitivity using Dye (II).

(II)

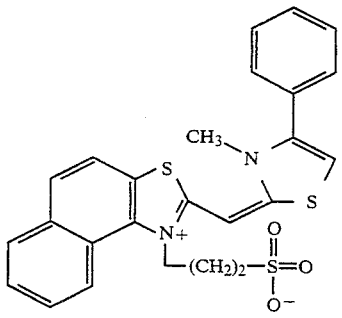

(III)

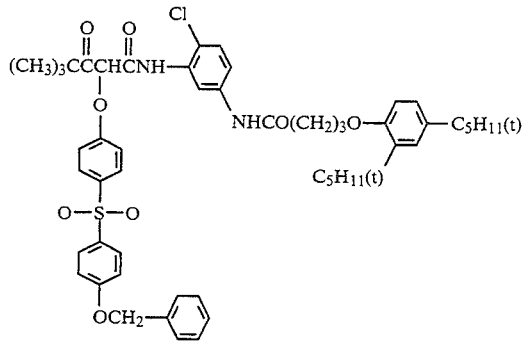

Example 13: Finishing Formula for Emulsion of Example 12

| To emulsion of Example 12 was added: | |
|---|---|
| Potassium Bromide | 325 mg/mole of Ag |
| Sodium Thiosulfate | 1.98 mg/mole of Ag |
| Potassium Tetrachloroaurate | 0.8 mg/mole of Ag |
| Heat ramped to 70° C., held for 60 min and then chilled to 43.3° C. | |
| Dye (II) | 270 mg/mole of Ag |
| 1,3-Acetamidophenyl-5-mercaptotetrazole | 97.5 mg/mole of Ag |
| Potassium Bromide | 1600 mg/mole of Ag |
| Chill set and stored at 4° C. | |

Example 14: Finishing Formula for Emulsion of Example 10

| To emulsion of Example 10 was added: | |
|---|---|
| Potassium Bromide | 227 mg/mole of Ag |
| Sodium Thiosulfate | 0.72 mg/mole of Ag |
| Potassium Tetrachloroaurate | 1.15 mg/mole of Ag |
| Heat ramped to 70° C., held for 60 min and then chilled to 43.3° C. | |
| Dye (II) | 323 mg/mole of Ag |
| 1,3-Acetamidophenyl-5-mercaptotetrazole | 97.5 mg/mole of Ag |
| Potassium Bromide | 1600 mg/mole of Ag |
| Chill set and stored at 4° C. | |

Example 15: Finishing Formula for Emulsion of Example 11

| To emulsion of Example 11 was added: | |
|---|---|
| Potassium Bromide | 221 mg/mole of Ag |
| Sodium Thiosulfate | 0.70 mg/mole of Ag |
| Potassium Tetrachloroaurate | 1.16 mg/mole of Ag |
| Heat ramped to 70° C., held for 60 min and then chilled to 43.3° C. | |
| Dye (II) | 314 mg/mole of Ag |
| 1,3-Acetamidophenyl-5-mercaptotetrazole | 97.5 mg/mole of Ag |
| Potassium Bromide | 1600 mg/mole of Ag |
| Chill set and stored at 4° C. | |

Examples 16 through 18: Photographic Evaluations

Figure 6:
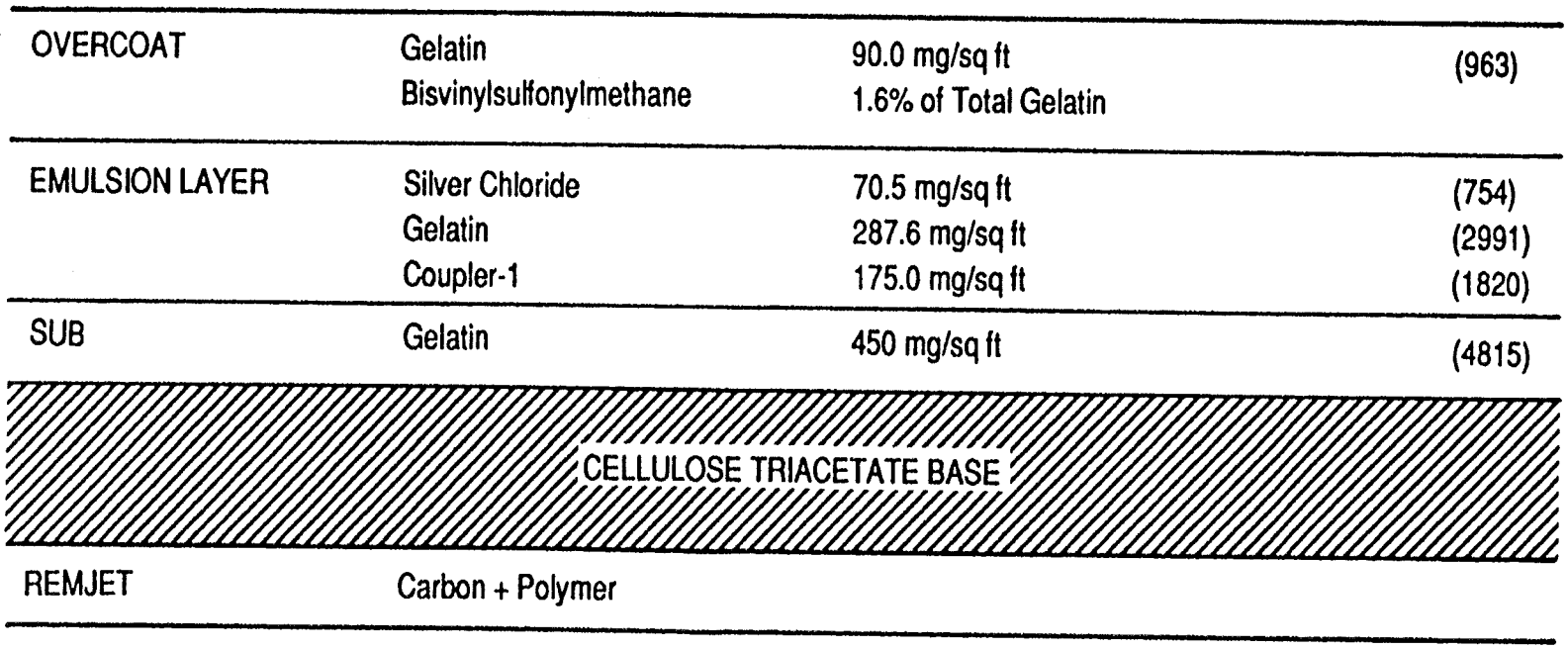
FIG. 6. Yellow monochrome coating format of Eastman Color Print for photographic evaluation of the emulsions of this invention.

Photographic testing of the gel-g-latex peptized AgCl emulsions were performed using the coating format as shown in FIG. 6. The yellow coupler used was (III). The coupler was conventionally dispersed in gelatin by standard milling techniques (RA-26).

Figure 7:
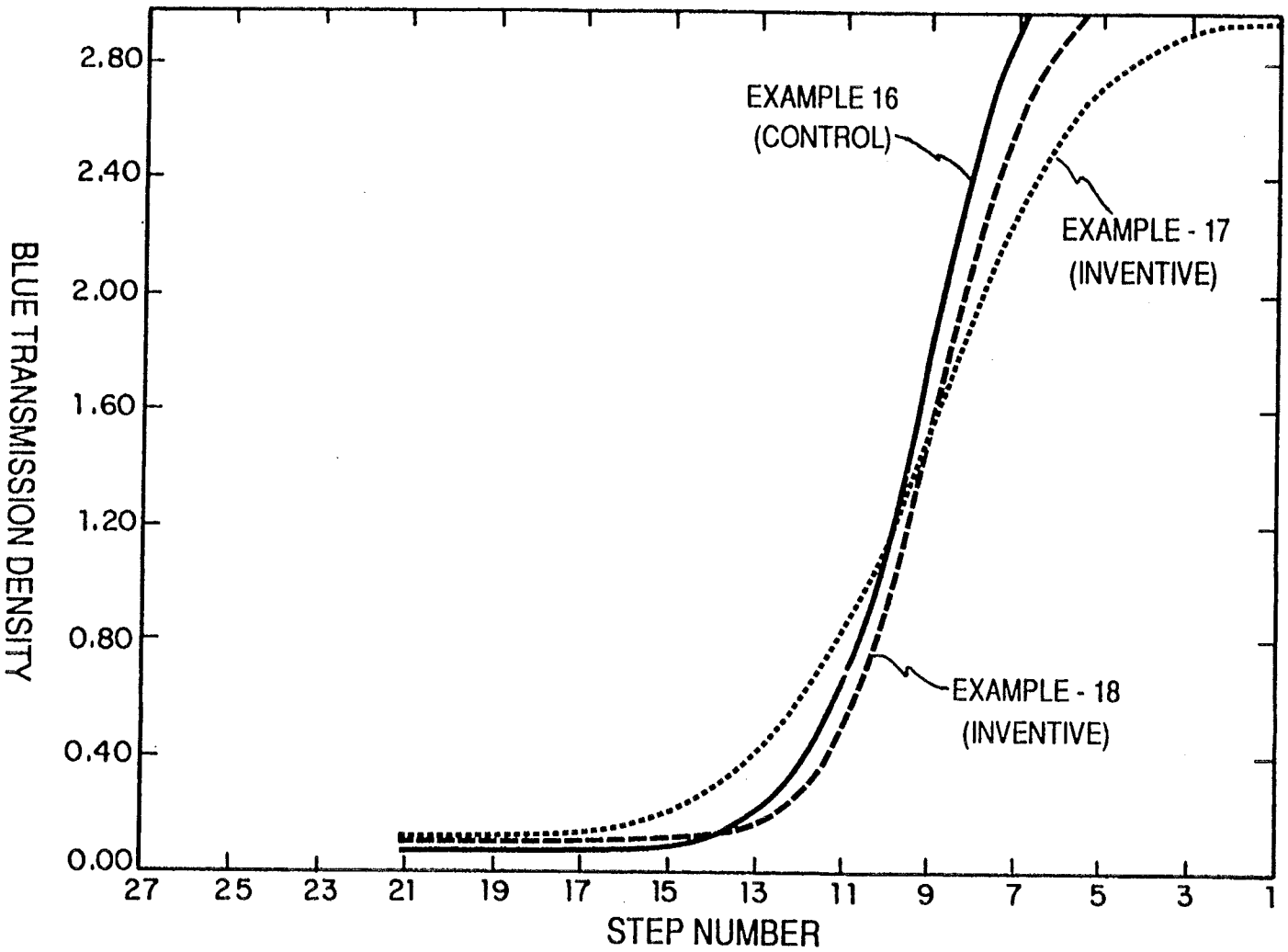
FIG. 7. Photographic sensitometric curves of Examples-16 through 18 coated according to the format of FIG. 6.

The spreading agents used for both the SOC and the emulsion layers were 0.75% of the melt volume of a 6.8% Triton TX-200E solution together with 0.25% of the melt volume of a 10% Olin 10-G solution. The coated strips were exposed in a Macbeth exposure device with a light source whose color temperature was balanced at 2850° K. for 0.002 sec through a neutral density stopwedge. The exposed strips were processed using the ECP-2 (Robot) process (RA-27) at 98° C. The measured blue sensitometry is shown in FIG. 7, using emulsion of Example 12, Example 10, and Example 11. Some of the photographic parameters of these sensitometric curves are listed in Table IV. It suffices to say that the photographic responses of the gel-g-latex precipitated emulsions are reasonably similar to that of the AgCl emulsion precipitated in gelatin as the peptizer. It is also interesting to note that the lime processed gel-g-latex emulsion coating of Example 18 behaved closer to the emulsion in control coating of Example 16 (FIG. 7 and Table IV). This clearly demonstrates the functional efficacy and utility of this invention of the novel peptizer, gel-g-polymer latex particles.

TABLE IV

Comparison of Photographic Responses of Gel-g-Latex Peptized AgCl Emulsions in Yellow Monochrome Format Compared with Lime Processed Ossein Gelatin Precipitated Case

| ID | Emulsion | D-min | Relative Speed[1] | Toe Contrast[2] |
|---|---|---|---|---|
| Example 16 | Example 12 (Lime processed ossein gelatin control) | 0.056 | 136 | 1.935 |
| Example 17 | Example 10 (Phthalated Gel-g-latex) | 0.117 | 128 | 1.456 |
| Example 18 | Example 11 (Lime processed ossein gelatin-g-latex) | 0.103 | 133 | 1.922 |

[1]At 1.0 density unit above D-min.
[2]Between density = 1.0 and the density at 0.4 log (exposure) lower.

The invention has been described in detail with particular reference to preferred embodiments thereof, but it will be understood that variations and modifications can be effected within the spirit and scope of the invention.

We claim:

1. A photosensitive silver halide crystalline emulsion composition comprising silver halide crystals with adsorbed gelatin-grafted-polymer particles attached to the surface of the silver halide crystals wherein said silver halide crystals with adsorbed gelatin-grafted-polymer particles attached to the surface are formed in a solution of said gelatin-grafted-polymer particles with substantially all gelatin in said solution bound to said polymer particles.

2. The composition of claim 1 wherein said silver halide crystals have a cubic, octahedral, or tabular crystal structure.

3. The composition of claim 1 wherein said silver halide crystals comprise silver chloride, silver iodobromide, or silver chlorobromide.

4. The composition of claim 1 wherein said silver halide crystals further comprise a dye that spectrally sensitizes said crystals to wavelengths of light of at least one of the following light ranges:

blue,
green,
red,
infrared, and
ultraviolet.

5. The composition of claim 1 wherein said silver halide crystals may have a single dimension ranging between about 10 nm and 10,000 nm.

6. The composition of claim 1 wherein said gel-grafted polymer particles comprise a photographic agent selected from at least one member of the group consisting of:

filter dyes,
development inhibitor release couplers,
development inhibitor anchomeric release couplers,
dye-forming couplers,
nucleators,
boosters for photographic development,
ultraviolet radiation absorbing compounds,
sensitizing dyes,
development inhibitors,
antifoggants, and
bleach accelerators.

7. The composition of claim 1 wherein said gel-grafted polymer particles comprise gelatin and a polymer selected from at least one member of the group consisting of:

polymeric filter dye,
polymeric development inhibitor release coupler,
polymeric development inhibitor anchomeric release coupler,
polymeric dye-forming coupler,
polymeric ultraviolet radiation absorbing compound,
polymeric development booster,
polymeric developer,
polymeric sensitizing dye,
polymeric development inhibitors,
polymeric antifoggants, and
polymeric bleach accelerators.

8. The composition of claim 1 wherein said gelatin-grafted polymer particles comprise a gelatin selected from the group consisting of:

acid processed ossein gelatin,
lime processed ossein gelatin,
phthalated gelatin,
acetylated gelatin, and
succinated gelatin.

9. A mixed-packet photosensitive photographic element comprising at least one of the following elements:

Red sensitive silver halide crystals with attached gel-grafted-cyan dye-forming coupler particles,
Green sensitive silver halide crystals with attached gel-grafted-magenta dye-forming coupler particles, and
Blue sensitive silver halide crystals with attached gel-grafted-yellow dye-forming coupler particles, wherein said silver halide crystals with attached gel-grafted-color-dye-forming coupler polymer particles are formed in a solution of said gel-grafted polymer particles with substantially all gel in said solution bound to said polymer particles.

10. The element of claim 9 wherein said silver halide crystals have a cubic, octahedral, or tabular crystal structure.

11. The element of claim 9 wherein said silver halide crystals comprise silver chloride, silver iodobromide, or silver chlorobromide.

12. The element of claim 9 wherein said silver halide crystals further comprise a dye that spectrally sensitizes said crystals to wavelengths of light of at least one of the following light ranges:

blue,
green,
red,
infrared, and
ultraviolet.

13. The element of claim 9 wherein said silver halide crystals may have a single dimension ranging between about 10 nm and 10,000 nm.

14. The element of claim 9 wherein said gel-grafted polymer particles comprise at least one photographic agent selected from at least one member of the group consisting of:

filter dyes,
development inhibitor release couplers,
development inhibitor anchomeric release couplers,
dye-forming couplers,
nucleators,
boosters for photographic development,
ultraviolet radiation absorbing compounds,
sensitizing dyes,
development inhibitors,
antifoggants, and
bleach accelerators.

15. The element of claim 9 wherein said gel-grafted polymer particles comprise gelatin and a polymer selected from at least one member of the group consisting of:

polymeric filter dye,
polymeric development inhibitor release coupler,
polymeric development inhibitor anchomeric release coupler,
polymeric dye-forming coupler,
polymeric ultraviolet radiation absorbing compound,
polymeric development booster,
polymeric developer,
polymeric sensitizing dye,
polymeric development inhibitors,
polymeric antifoggants, and
polymeric bleach accelerators.

16. The element of claim 9 wherein said gelatin-grafted polymer particles comprise a gelatin selected from the group consisting of:

acid processed ossein gelatin,
lime processed ossein gelatin,
phthalated gelatin,
acetylated gelatin, and
succinated gelatin.

17. The element of claim 9 wherein said coupler particles are attached to the surface of said silver halide crystals.

* * * * *